United States Patent [19]

Fox et al.

[11] Patent Number: 4,666,414

[45] Date of Patent: May 19, 1987

[54] FLOTATION DEVICE

[76] Inventors: Nelson C. Fox, Ferry Reach; Rosetta Fox, Ferry Reach, Anchorage View, both of, St. Georges, Bermuda

[21] Appl. No.: 711,278

[22] Filed: Mar. 13, 1985

[51] Int. Cl.[4] ..... B63B 9/10

[52] U.S. Cl. ..... 441/129

[58] Field of Search ..... 5/436, 434, 442; 441/74, 75, 129, 135; 297/391

[56] References Cited

U.S. PATENT DOCUMENTS

| | | | |
|---|---|---|---|
| 2,404,109 | 7/1946 | Steele | 297/391 |
| 4,234,990 | 11/1980 | Colburn | 441/75 |
| 4,247,961 | 2/1981 | Masch et al. | 5/442 |

FOREIGN PATENT DOCUMENTS

| | | | |
|---|---|---|---|
| 3107065 | 9/1982 | Fed. Rep. of Germany | 441/74 |

*Primary Examiner*—Alexander Grosz

*Attorney, Agent, or Firm*—Berman, Aisenberg & Platt

[57] ABSTRACT

A flotation device has a plurality of waterproof, zip-fastened compartments for storing food, water and signalling equipment for use by a person in distress.

10 Claims, 3 Drawing Figures

FIG. 1
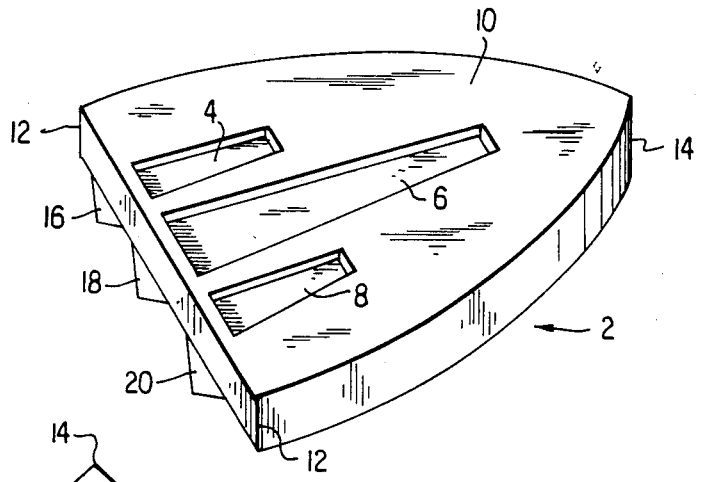
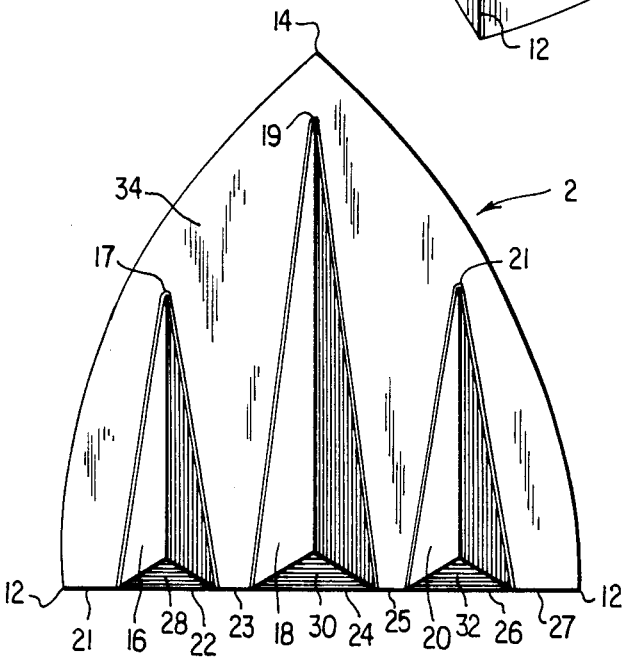
FIG. 2
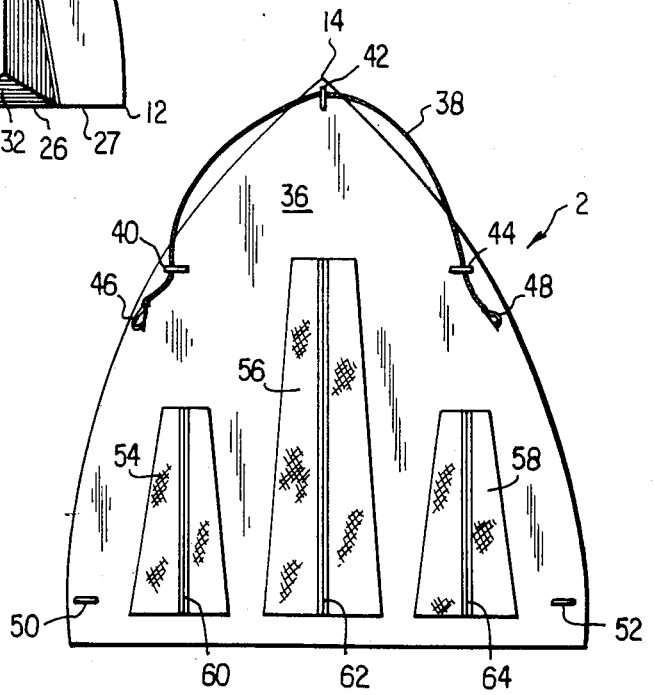
FIG. 3

FLOTATION DEVICE

FIELD OF THE INVENTION

This application relates to a flotation device for a person in need of rescue from the ocean.

DESCRIPTION OF THE PRIOR ART

Flotation devices for use by a person in need of rescue are known in the art, but problems connected with providing a lightweight, inexpensive device having storage compartments for food, water and signalling gear have not been satisfactorily solved.

SUMMARY OF THE INVENTION

A seaman's pillow flotation device having closable, waterproof, inner compartments for storing food, water and signalling gear is made of fiberglass and rubber with foam flotation material.

An object of the invention is to provide a simple, low-cost, flotation device having closable, waterproof, storage compartments.

BRIEF DESCRIPTION OF THE DRAWINGS

FIG. 1 is a perspective view of a flotation device of the invention showing the compartments without top coverings.

FIG. 2 is a bottom plan view of the flotation device of FIG. 1.

FIG. 3 is a top plan view of the flotation device of FIG. 1, with top coverings, ready for use.

DETAILED DESCRIPTION OF THE INVENTION

A seaman's pillow is a flotation device for use by a person in need of rescue from the ocean.

Referring to FIGS. 1 to 3, in which like numerals represent like parts, FIG. 1 shows seaman's pillow 2, preferably made of fiberglass or rubber, having inner compartments 4, 6, 8. The remaining inner cavity 10 is filled with polystyrene foam or similar flotation material.

In a non-limiting example, the seaman's pillow has a height of the outer sides 12, at the rear, of 4", and a height at the outer sides 14, at the front, of 6". The overall length is about 31" from rear centerpoint to front centerpoint. Rear width is about 30". Floats 16, 18, 20 underlie the seaman's pillow, and are more clearly shown in FIG. 2.

The dimensions of side compartments 4, 8 are 12" in length, and 7" in height, with a rear width of 5", and a front width of 3". The dimensions of inner compartment 6 are 21" in length, and 9" in height, with a rear width of 7", and a front width of 5". These dimensions are for example only.

The frame and compartment structure is made to these approximate dimensions, and the inner spaces remaining (other than the compartments) are filled with polystyrene foam or other flotation material.

FIG. 2 shows a bottom view of seaman's pillow 2, seen from the rear, showing three V-shaped pontoon-type floats 16, 18, 20. Segments 21, 22, 23, 24, 25, 26 and 27 of the rear edge of the seaman's pillow are approximately 3⅝", 5½", 2¼", 7", 2¼", 5½" and 3⅝" respectively. The height of each of the outer pontoon-floats 16, 20 is about 3", and the length of each float 16, 20 is about 17½". Each float 16, 18, 20 is triangular in cross-section and pyramidal in shape, and converges to points 17, 19, 21 respectively, on bottom surface 34 of seaman's pillow 2. Each float 16, 18, 20 has a triangular-shaped end 28, 30, 32 respectively, at the rear of the device 2, outer floats 16, 20 having a triangular-shaped end 28, 32 of height 3" and sides 4"×4"×5½", and a length from points 17, 21 to the back edge of 17½". Center float 18 has a triangular-shaped end 30 of height 5" and sides 6"×6"×7". Center float 18 is about 27" in length from point 19 to corners of triangle 30 at the back edge of the seaman's pillow.

FIG. 3 shows seaman's pillow 2 with its top surface 36 in place. Rope 38, preferably nylon rope is threaded through rings 40, 42, 44 fastened to the top of the device 2, each ring being placed about 1" in from the edge, side rings 40, 44 being spaced about 15" from center ring 42. "Dog-clip" fastening latches 46, 48 are secured to each end of the nylon rope, which extends past side rings 40, 44 about 6" at each end. The nylon rope is thus about 42" in length, in this example. Latches 46, 48 may be hooked to shark protector suits, for example. Two further rings 50, 52 are secured at each rear corner of top surface 36 of device 2, to which a rope may be fastened or latched.

Three compartments 4, 6, 8 (FIG. 1) are provided for storage of food, water and signalling gear, which are closed by waterproof rubber coverings 54, 56, 58 with zip-fasteners 60, 62, 64. Side compartments 4, 8 have surface dimensions of front width 3", rear width 5", and length 12". Center compartment 6 has surface dimensions of front width 5", rear width 7", and length 21". The zip-fastened waterproof compartments are used for storing waterproof bags of food, water, flares, and other signalling or rescue gear.

The seaman's pillow is a lightweight flotation device, well equipped for rescue needs, the body of the pillow giving proper support for a person needing a place to rest while waiting for rescue. A person in distress can grasp the front end of the seaman's pillow or rope 38 and rest his head and/or the upper part of his body on the device. The device may be used as a float, while the user opens the compartments and removes and uses the supplies stored therein. The seaman's pillow may also be used as a swimming aid. A person may be secured to the seaman's pillow by holding on, or latching to, the nylon rope provided. The dimensions stated are non-limiting examples of suitable sizes for components of the device of the invention.

The seaman's pillow is stored in lifeboats, helicopters, or other place accessible during an emergency.

While the invention has been described above with reference to certain embodiments thereof, it will be appreciated that various changes and modifications may be made without departing from the spirit and scope of the invention.

What is claimed is:

1. A flotation device comprising body means for providing a resting place for a user, a plurality of float means attached to the body means for providing buoyancy to the flotation device, a plurality of waterproof compartment means within the body means for storing supplies, a plurality of waterproof closure means for water tightly enclosing said compartment means, a plurality of holding means attached to said body means for supporting a rope, and rope means supported by a plurality of said holding means for providing support to a user, wherein each float means is triangular in cross-section and pyramidal in shape and is attached to the body means adjacent to and below the compartment means.

2. Flotation means of claim 1 wherein the waterproof closure means is rubber.

3. Floatation means of claim 1 further comprising means for opening and closing said waterproof closure means.

4. Flotation means of claim 3 wherein the means for opening and closing comprises zip-fastener means.

5. Flotation means of claim 1 further comprising latch means for securing to a loop on clothing of a user.

6. Flotation means of claim 4 wherein the latch means comprises rope.

7. Flotation means of claim 1 further comprising signalling equipment within said compartment means.

8. Flotation means of claim 1 further comprising food and water within said compartment means.

9. Flotation means of claim 1 wherein the compartment means extends at least partly within the bounds of the float means.

10. A flotation device comprising body means for providing a resting place for a user, a plurality of float means attached to the body means for providing buoyancy to the flotation device, a plurality of waterproof compartment means within the body means for storing supplies, a plurality of waterproof closure means for water tightly enclosing said compartment means, means for opening and closing said waterproof closure means, a plurality of holding means attached to said body means for supporting a rope, and rope means supported by a plurality of said holding means for providing support to a user, wherein each float means is triangular in cross-section and pyramidal in shape and is attached to the body means adjacent to and below the compartment means, the compartment means extending at least partly within the bounds of the float means.

* * * * *